US008356372B2

(12) United States Patent
Smalling et al.

(10) Patent No.: US 8,356,372 B2
(45) Date of Patent: Jan. 22, 2013

(54) SYSTEMS AND METHODS FOR HINGED BEDDING ASSEMBLIES

(75) Inventors: Scott H. Smalling, Roy, WA (US); Jack J. Squires, Gig Harbor, WA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 13/307,367

(22) Filed: Nov. 30, 2011

(65) Prior Publication Data

US 2012/0066838 A1 Mar. 22, 2012

Related U.S. Application Data

(63) Continuation of application No. 11/880,952, filed on Jul. 24, 2007, now abandoned.

(51) Int. Cl.
*A47C 23/04* (2006.01)
*A47C 17/00* (2006.01)

(52) U.S. Cl. ..... 5/718; 5/730; 5/722; 5/690; 5/740

(58) Field of Classification Search ..... 5/722, 690, 5/730, 618, 500, 482, 495, 413 R, 691, 740, 5/419, 420, 413 AM
See application file for complete search history.

(56) References Cited

U.S. PATENT DOCUMENTS

| | | | | |
|---|---|---|---|---|
| 2,830,306 | A | 4/1958 | Wagner et al. | |
| 3,541,620 | A | 11/1970 | Chapuis | |
| 3,667,075 | A | 6/1972 | Ballard et al. | |
| 4,095,296 | A | 6/1978 | Ferro | |
| 4,316,298 | A | 2/1982 | Russo et al. | |
| 4,336,621 | A | 6/1982 | Schwartz et al. | |
| 4,782,540 | A | 11/1988 | Parker | |
| 4,955,096 | A | 9/1990 | Gilroy et al. | |
| 5,657,500 | A | 8/1997 | Messina | |
| 6,088,857 | A | 7/2000 | Ogle | |
| 6,202,239 | B1 | 3/2001 | Ward et al. | |
| 6,295,674 | B1 | 10/2001 | Smith-McKelvey et al. | |
| 6,460,209 | B1 | 10/2002 | Reeder et al. | |
| 6,711,766 | B2 | 3/2004 | Monk et al. | |
| 7,191,483 | B2 | 3/2007 | Hochschild | |
| 2002/0078509 | A1* | 6/2002 | Williams | 5/716 |
| 2003/0221256 | A1* | 12/2003 | Monk et al. | 5/420 |

FOREIGN PATENT DOCUMENTS

| | | | |
|---|---|---|---|
| GB | 2225229 | A | 5/1990 |
| NL | 6602793 | | 9/1966 |
| NL | 1001032 | | 8/1995 |
| WO | 2007010277 | A3 | 1/2007 |

* cited by examiner

*Primary Examiner* — Jonathan Liu
(74) *Attorney, Agent, or Firm* — Cantor Colburn LLP

(57) ABSTRACT

In many aspects, the systems and methods described herein include a mattress having a top sleeping layer disposed on top of a support layer. The support layer includes a polyurethane foam having channels aligned with the joints of the articulated sections of the foundation or frame of the adjustable bedding assembly. When the sections articulate about the joints, the channels allow the overlying top layer to conform to the sections while reducing wear and tear therein.

10 Claims, 6 Drawing Sheets

SYSTEMS AND METHODS FOR HINGED BEDDING ASSEMBLIES

CROSS-REFERENCE TO RELATED APPLICATION

This application claims the benefit of and is a continuation of U.S. Non-Provisional application Ser. No. 11/880,952 filed Jul. 24, 2007, published as U.S. Publication. No. 2009/0025150A1, which is incorporated herein by reference in its entirety.

FIELD OF THE INVENTION

This invention relates to mattresses and mattress assemblies for adjustable beds, and more generally, assemblies for adjustable furniture.

BACKGROUND OF THE INVENTION

Adjustable bed constructions typically include a mattress placed on top of a rigid foundation having articulating arms that move the entire mattress or portions thereof. The foundation includes a plurality of sections that may be adjusted relative to one another such that mattresses that are disposed on the foundation, bend and conform with the articulated sections of the rigid foundation to provide comfort or therapy as needed. However, repeated bending and articulation of the mattresses near the joints of the articulated sections often cause wear and tear and reduce the of the mattresses.

For example, in conventional innerspring mattresses, springs distort near the joints and at the edges from bending. Conventional innerspring mattresses include stabilizing and reinforcing structures such as sturdy border wires along top and bottom edges to prevent sagging and increase lifespan. These stabilizing and reinforcing structures make the mattress uniformly resilient in the direction required to support the horizontal body. However, these structures resist bending as required on an articulated bed. Consequently, such stabilizing and reinforcing structures are limited in their use in articulated beds. As a result, articulated mattresses of the prior art may have a shorter useful life and do not provide the uniform body support necessary for this application.

Conventional foam mattresses that are currently being used in adjustable bed constructions, also suffer from the similar drawbacks. In particular, foam mattresses are typically disposed on top of the rigid articulated foundation and experience significant wear and tear near the joints that compromise the integrity of the foam structure and reduce its lifespan. In addition, since the mattresses are artificially forced to bend along the joints of the foundation, they tend to not fully conform with the articulated sections. Consequently, portions of the foam mattress, when articulated, may be raised or lowered unevenly or slide out of position.

Accordingly, there is a need for an improved mattress construction that can be used in an articulated bed.

SUMMARY OF THE INVENTION

The systems and methods described herein are directed to mattresses and mattress assemblies for adjustable beds, and more generally, articles for adjustable furniture. For purposes of clarity, and not by way of limitation, the systems and methods may be described herein in the context of providing mattresses for adjustable bedding assemblies. However, it may be understood that the systems and methods described herein may be applied to provide for any cushioning article associated with any type of adjustable furniture. For example, the systems and methods of the invention may be used to provide futon mattresses, seat cushions, including automotive seat cushions, sofa cushions, pillows and other such cushions and supports.

More particularly, the mattresses described herein have multiple flexure points for articulating the mattress into different positions. The mattresses include a top layer having a top surface and a bottom surface, a support foam layer disposed below the bottom surface of the top layer, having a top surface, a bottom surface, a first side wall, a second side wall, and a support layer thickness, wherein the support foam layer includes a first channel extending from the first side wall to the second side wall along the bottom surface of the support foam layer, and a second channel extending from the first side wall to the second side wall along the top surface of the support foam layer, wherein the first and the second channels each comprise a first vertical wall and a second vertical wall, the vertical walls spaced a width apart by a bottom wall, and wherein the first channel has a first depth less than the support layer thickness and the second channel has a second depth less than the support layer thickness, the first and second channels defining the flexure points, and a rubberized material disposed at about one or more of the flexure points.

In another embodiment, a mattress having multiple flexure points for articulating the mattress into different positions includes a top layer having a top surface and a bottom surface, and a support foam layer disposed below the bottom surface of the top layer, having a top surface, a bottom surface, a first side wall, a second side wall, and a support layer thickness, wherein the support foam layer includes a first channel extending from the first side wall to the second side wall along the bottom surface of the support foam layer, and a second channel extending from the first side wall to the second side wall along the top surface of the support foam layer, and wherein the first channel has a first depth less than the support layer thickness and the second channel has a second depth less than the support layer thickness, wherein the first and the second channels each comprise a first vertical wall and a second vertical wall, the vertical walls spaced a width apart by a bottom wall, wherein the width is constant across the support foam layer and is within a range of about ⅛ inch to 1.5 inches, and wherein the first and second channels define the flexure points.

DETAILED DESCRIPTION OF THE ILLUSTRATED EMBODIMENT

The foregoing and other objects and advantages of the invention will be appreciated more fully from the following further description thereof, with reference to the accompanying drawings wherein.

DESCRIPTION OF THE PREFERRED EMBODIMENT

To provide an overall understanding of the invention, certain illustrative embodiments will now be described, including an articulated hinged mattress having channels in the support foam layer. However, it will be understood by one of ordinary skill in the art that the systems and methods described herein may be adapted and modified for other suitable applications and that such other additions and modifications will not depart from the scope hereof.

In many aspects, the systems and methods described herein provide an articulated mattress suitable for use with an adjustable mattress foundation. The mattress described herein includes one or more padding layers disposed on top of a support foam layer. The top surface and the bottom surface of the support foam layer include channels comprising one or more slits that may function as hinges for articulation. The channels may help to reduce wear and tear on the hinging portions of the mattress.

Figure 1:
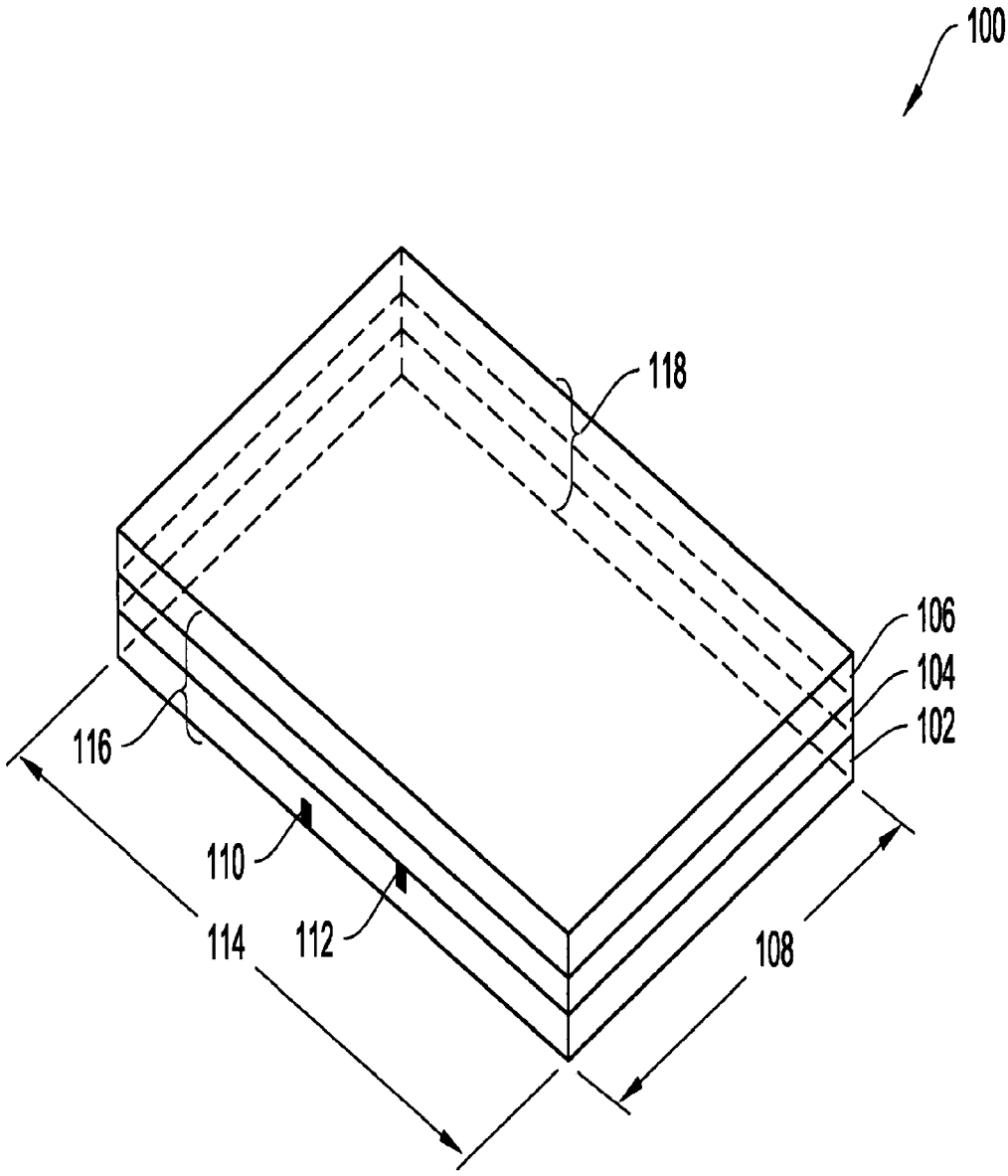
FIG. 1 is a perspective view of an adjustable mattress, according to an illustrative embodiment of the invention.

More particularly, FIG. 1 depicts an adjustable mattress 100, according to an illustrative embodiment of the invention. Although the mattress 100 is depicted as having a rectangular plan, it will be understood that the mattress may be sized and shaped as desired without departing from the scope of the invention. The mattress 100 includes a top layer 106 and a middle layer 104 that are disposed on a support foam layer 102. The mattress 100 may have standard dimensions, with a length 114, a width 108, a side 116, and another side 118 corresponding to at least the dimensions of a king, queen, double, or twin mattress. The support foam layer 102 includes a channel 110 formed on the bottom surface and a channel 112 formed on the top surface. The channels 110 and 112 may extend from the sidewall 116 to the sidewall 118 in transverse direction along the mattress 100. In an exemplary bed assembly, the mattress 100 may be disposed on top of an adjustable foundation or frame having articulating sections. The channels 110 and 112 may be aligned with one or more joints of the articulating sections of the foundation. During operation, as the articulating sections of the foundation are moved relative to one another, one or more regions of the support foam layer 102 articulate about the channel 110 and/or channel 112, thereby allowing one or more regions of the top layer 106 and middle layer 104 to be raised or lowered. In one example, the channels 110 and 112 are positioned near the head and foot regions, respectively, of the mattress. In such an example, the head portion may be raised and the foot portion may be lowered to bring a person from a laying down position to a sitting position. In certain embodiments, as described further with reference to FIG. 4A, the support foam layer 102 includes an additional channel near the neck region to offer added support for the user.

The support foam layer 102 may be a polyurethane foam. The support foam layer 102 may be formed other suitable materials without departing from the scope of the invention. In certain embodiments, the support foam layer 102 is formed from a material having an IFD (or ILD) value from about 30 to about 50. The support foam layer 102 may have a weight density of about 1 lb. to about 5 lbs. In certain embodiments, the support foam layer 102 may have a weight density of greater than 2 lbs. The support foam layer 102 may have weight, rigidity, density, and flexibility values as desired depending on the nature of the application. In certain embodiments, the support foam layer 102 includes polyurethane foam having a substantially consistent and relatively uniform density across the length and width of the layer. As noted earlier, the support foam layer 102 includes a channel 110 formed on the bottom surface and a channel 112 formed on the top surface. The channels 110 and 112 may be formed by cutting, slicing or carving portions of the support foam layer 102 as desired, or by molding foam with channel structures. The channels 110 and 112 may include one or more slits that allow the support foam layer to articulate about region of the channels 110 and 112, thereby minimizing stretching and tearing of the support foam layer 102 or layers 104 and 106. Certain illustrative characteristics of the channels in the support layer will be further described with reference to FIG. 2.

In certain embodiments, the top layer 106 the middle layer 104 includes the mattress core. In such embodiments, the mattress core includes an innerspring mattress comprising coils, encased coils (such as POCKETED springs) or Marshall Coils. The top layer 106 and/or the middle layer 104 may include polyurethane materials. In certain embodiments, the top layer 106 and/or the middle layer 104 include foam, visco-elastic foam and/or latex foam. The top layer 106 and/or the middle layer 104 may include a combination of an innerspring mattress core combined with foam material, as described with reference to FIG. 5.

The top layer 106 an/or the middle layer 104 may be formed from a sheet of fabric, felt, or polymer, a cotton, nylon, or polyester batting, or from a layer of foam, plastic, polymer, natural fiber, synthetic fiber, or any other material or a combination thereof. In one optional embodiment, the mattress 100 may have cover panel that comprises a non-quilted mattress cover with an optional smooth sleeping surface. In this embodiment, a multi-layer, typically three layer, crowned mattress panel may be provided over the upper surface of the mattress. For example, a crowned cover panel may be formed from a top fabric layer, an intermediate filler layer and a backing layer. Optionally, there may be a layer of flame retardant material or combination of materials. In either embodiment, the top layer may be a fabric layer of cotton, linen, synthetic fibers or some other material of combination of materials.

The top layer 106, middle layer 104 and any additional layers may be formed from any suitable materials without departing from the scope of the invention. In certain embodiments, the mattress 100 further includes one or more filler layers. The filler layer can be formed from any padding material, such as foam, cotton batting, gel, latex foam, visco-elastic foam or other known padding materials and or combination of padding materials. Optionally, the filler layer provides a layer of conventional filling and padding material that may be laid over the mattress.

An optional fire resistant layer may be disposed in mattress 100 in between at least two of the top layer 106, middle layer 104 and support foam layer 102. The fire resistant layer optionally extends over the at least entire upper surface of the mattress panel and around the borders of the panel. The flame resistant material may be any suitable material, such as for example polyaramid material (such as KEVLAR™), PET (polyester) binder fiber, organophosphorous materials, halogenated organic materials (typically halogenated with chlorine or more popularly bromine) or nitrogen based compounds. Commercially available materials are sold under the trade names NOMEX, KEVLAR™, and the actual material employed may depend upon the particulars of the application, including mattress type (e.g. open coil, encased coil, foam, water), mattress size, material costs and other such design considerations.

Under the fire resistant layer, a backing layer may be attached. The backing layer may be formed from a sheet of material, such as natural fibers such as cotton or linen, aluminum, fiberglass, synthetic fibers or a mixture thereof. These three layers may be joined together to form a crowned panel and that panel may be placed over the upper surface and joined to the mattress to provide a smooth sleeping surface. In addition, the mattress 100 typically includes a fabric or plastic covered structure having an internal construction configured to provide comfort for a user resting on the surface. Finally, the mattress 100 may also include a removable cover that helps prevent allergens on the surface.

Figure 2:
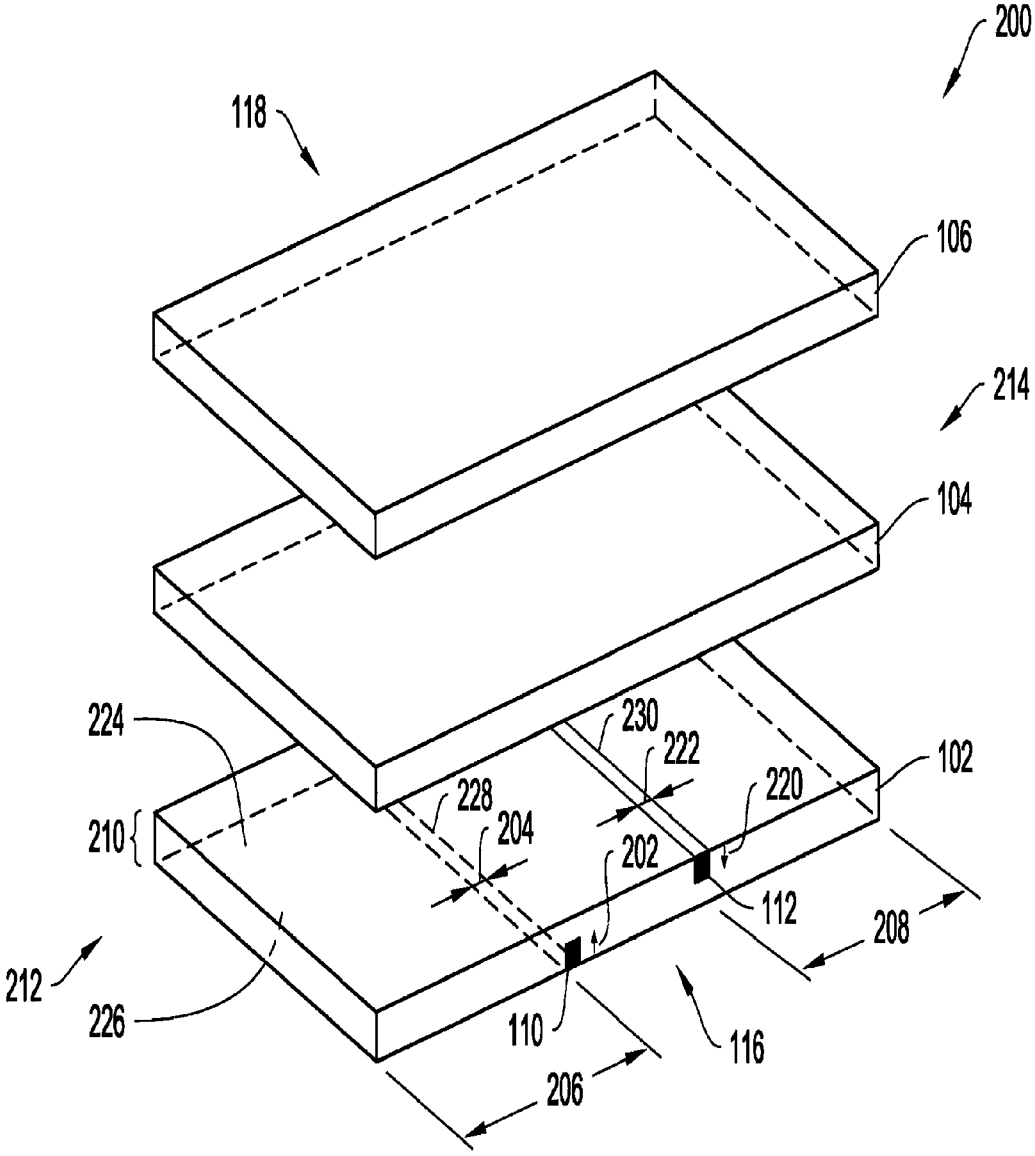
FIG. 2 illustrates an unassembled view of the mattress of FIG. 1, according to an illustrative embodiment of the invention.

FIG. 2 illustrates an unassembled view 200 of the mattress 100 having a top layer 106, a middle layer 104 and a support layer 102. The support layer 102 includes a top surface 224 and bottom surface 226, and has a thickness 210 which may be about 1 inch to about 8 inches. In certain embodiments, the support layer 102 has a thickness from about 2 inch to about 7 inches, or about 3 inches to about 5 inches. The first channel 110 lies at a distance 206 away from the edge of the head region 212, and the second channel 112 lies at a distance 208 away from the edge of the foot region 214 of the mattress 100. In one example, the first channel 110 may be from about 25 inches to about 40 inches from the head region 212, or about 29 inches to about 38 inches, or further, about 33 inches to about 35 inches. Similarly, the second channel 112 may be from about 22 inches to about 37 inches from the foot region 214, or about 25 inches to about 34 inches, or further, about 28 inches to about 31 inches. The distance 206 or 208 may be adjusted to suit the dimension, mechanical, functional requirements of the mattress. For example, the distances 206 and 208 may be selected based on whether the mattress is sized as a king, queen or twin. In certain embodiments, these dimensions may be customized to an individual's body size.

As shown, the first channel 110 extends from sidewall 116 to sidewall 118 creating a slit 228 along the bottom surface 226. Likewise, the second channel 112 extends from sidewall 116 to sidewall 118 creating a slit 230 along the top surface 224 of the support foam layer 102. In certain embodiments, the channels may include a plurality of parallel slits which may also further delay tearing, as will be described with reference to FIG. 4A and 4B. Further, the first channel 110 cuts into the support foam layer 102 to a height 202, and therefore depth, from bottom surface 226. Similarly, the second channel 112 cuts into the support foam layer 102 to a depth 220 from the top surface 224. In certain embodiments, the depth of each slit may be about 1/15 to about 13/15 of thickness of the support foam layer 102. Alternatively, the range of the depth may be from about 1/10 to 7/10, or about 1/4 to about 1/2 of the thickness of the support foam layer 102. In one example, a support layer 102 that is about 4 inches thick may have a slit ranging in depth from about 1/4 inch to about 3.5 inches. The depths 202 and 220 may be selected as desired to allow for the articulation of the mattress while also maintaining the integrity of the hinge areas, especially when used in combination with an articulating platform/foundation. Further, the depth of each slit 202 and 220 may be the same or different for one or more slits in either channel 110 and 112.

The channels 110 and 112 have a width 204 and 222, respectively, and may be from about 1/8 inch to about 1.5 inches. The width of the channels may further range from about 1/6 inch to about 1 inch, or about 1/4 inch to about 1/2 inch. The width 204 and 222 of slits may be selected as desired to allow, among other things, improved articulation of the mattress by minimizing soft spots on the top layer 106 of the mattress, and improving the integrity of the mattress. In certain embodiments, the axes along which the slits 228 and 230 extend on the top surface 224 and the bottom surface 226 are perpendicular with respect to the sides 116 and/or 118 of the mattress 100.

As such, the slits 228 and 230 in channels 110 and 112, respectively, have a depth and width to allow for ease of articulation suitable for the dimensions and material of the mattress. Additionally, the dimensions of the depth and width of the channels, in combination with their placement at distances 206 and 208 from the head and foot regions, respectively, may be determined based on the application, degree and nature of the articulation needed. Moreover, in an alternative embodiment of the invention, the mattress is suited to offer better conformability when used in combination with an articulated base, as will be described with reference to FIG. 3.

Figure 3:
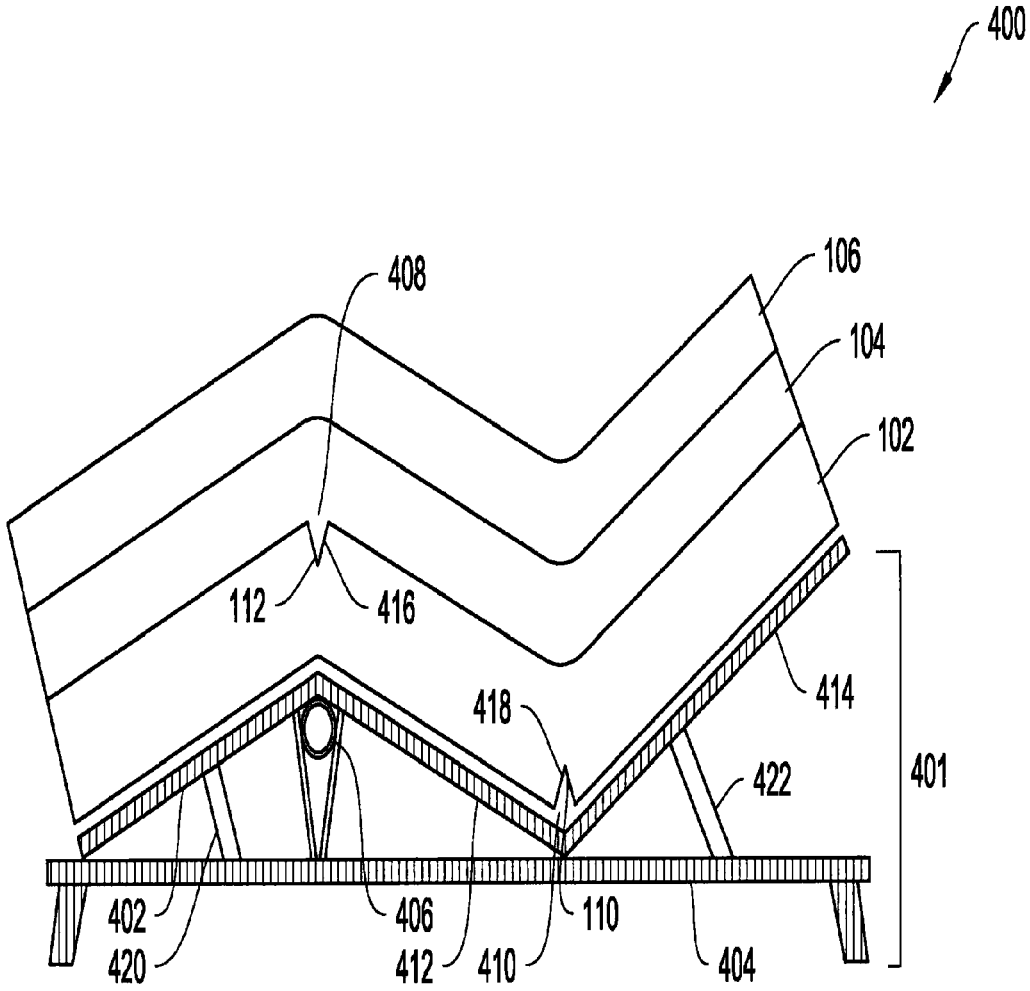
FIG. 3 is a perspective view of the mattress in operation, according to an illustrative embodiment of the invention.

Depicted in FIG. 3 is an adjustable bed assembly 400 in operation, according to an illustrative embodiment of the invention. The bed assembly 400 includes a mattress 100 (FIG. 1) disposed on an adjustable foundation 401 comprising an articulating platform having articulating sections 402, 412 and 414 connected to a rigid base 404 via the actuating system 420 and 422. As shown, the channels 110 and 112 open to allow, among other things, articulation of the mattress and to reduce the mechanical stress that results on the pressure points 408 and 410 when the mattress is caused to articulate. The channels may also act to localize the pressure points 408 and 410 to the joints of the articulating sections 416 and 418, thereby minimizing unwanted tearing that may otherwise happen in several places. Additionally, the channels may ensure suitable flexing of the mattress to better conform with the articulating platform. For example, this feature may be particularly appreciated by users of different weights and sizes. The channels encourage the full range of articulation without the need for a heavier user's mass to conform the mattress against the articulating sections 402, 412, 414, for example. As such, small and large users may experience similar levels of comfort during articulation that may be independent of their size and weight. In certain embodiments, a rubberized material may be sprayed at the point 408 and 410 to further retard tearing. The rubberized material may be applied to the channels 110 and 112 at, among other places, along the interior of the slits.

In certain embodiments, the mattress 100 may be adjusted to other possible configurations to allow the user to choose the position of the head and foot of the bed for maximum comfort. In an alternative embodiment of the invention, the actuating system 420 and 422 may be programmed to an array of custom configurations.

Figure 4A:
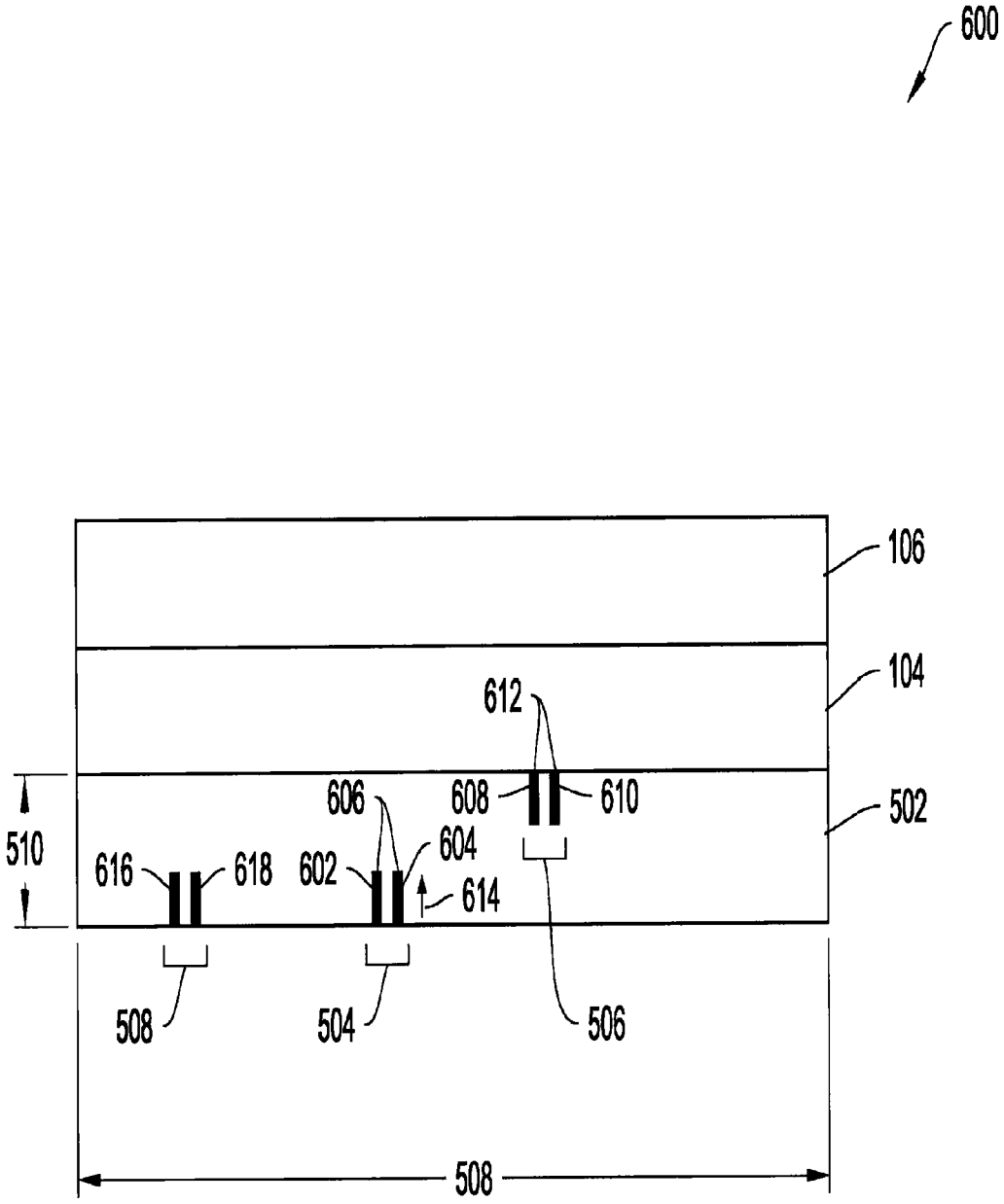
FIGS. 4A and 4B depict a cross-section view of mattresses, according to an illustrative embodiment of the invention.
Figure 4B:
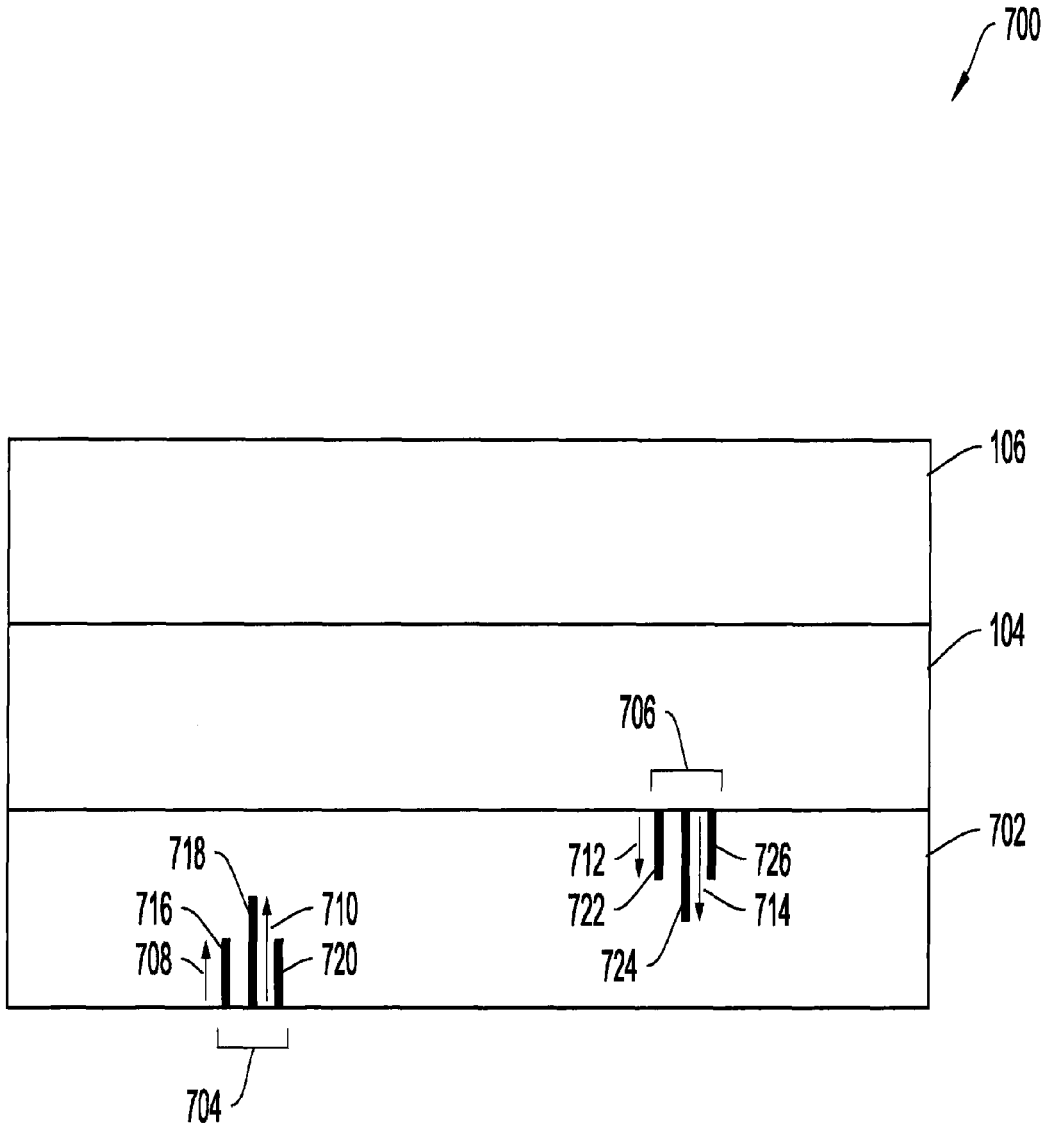

FIGS. 41 and 4B illustrate a cross-section views of mattresses in which the support foam layer 502 or 702 includes channels having a plurality of parallel slits 504 and 506 or 704 and 706. Mattress 600 and 700 of FIGS. 4A and 4B may be similar to mattress 100 of FIG. 1. Similarly, the mattress 600 or 700 includes a top layer 106, a middle layer 104, and a support foam layer 502 or 702 comprised of foam material as described previously.

More particularly, FIG. 4A depicts the channels 504 and 506 that extend through the support foam layer 502 having a thickness 510 of about 1 inch to about 8 inches. Alternatively, the support layer 502 may have a range of thickness, from about 1.5 inches to about 6.5 inches, or about 2 inches to about 5 inches. As shown, each channel includes two slits: slits 602 and 604 included in channel 504, and slits 608 and 610 included in channel 506. The slits included in each channel may be parallel to each other and are separated by a distance that is measured from the inner adjacent edges of each slit, as shown in 606 and 612. In one example, the distance between the slits may be from about 1/8 inch to about 2 inches. The distance between the slits may range from about 1/6 inch to about 1.5 inches, or about 1/3 inch to about 1 inch, and may vary according to the dimensions of the mattress, and the degree of articulation desired. Further, similar to that described in FIG. 2, each slit of the channel has a height 614 that is a measure of its depth into the thickness of the support foam layer. By way of illustration, the height of only one slit 614 is depicted. However, all slits that comprise the channels have a height, and therefore depth, in the support foam layer 502. In certain embodiments, the depth of each slit may or may not be the same for all slits. Each slit may have a width which may be determined according to the criteria described in FIG. 2. Additionally, although two slits are illustrated for each channel in FIG. 4A, the invention may include a plurality of slits per channel, as shown in FIG. 4B. In certain embodiments, the support foam layer 502 may include an additional channel 508. The channel 508, includes two parallel slits 616 and 618, and lies at the head/neck region of the mattress. However, the placement of additional channels is not restricted to this configuration; instead, additional channels may be placed to suit the needs of the user and/or the configuration of the foundation. Slit dimensions for all channels may be selected as desired depending on at least the criteria of the aforementioned descriptions.

By way of example, FIG. 4B depicts a mattress having three parallel slits per channel in its support foam layer. Slits 716, 718 and 720 form channel 704 and slits 722, 724, and 726 form channel 706. As indicated, the middle slit 718 or 724 has a height 710 or 714, respectively, and is flanked by shorter slits 716 and 720 or 722 and 726, respectively. As described previously, since each height defines the depth of each slit into the support foam layer, the middle slit in this example forms the deepest groove. The slits on either side may be of the same or different depths. As previously described, the distances between slits are designed to be sufficiently wide to allow flexibility, while adequately narrow to maintain the integrity of the mattress as well as to prevent soft spots on the top layer 106. In certain embodiments, the configuration of the multi-slit channels 704 and 706 may allow for smaller distances between slits to minimize the likelihood of the formation of soft spots on its top layer while maintaining the range of motion needed for the mattress. Moreover, the added slits may act to reduce the mechanical stress on the points of articulation since the pressure may be distributed to several slits.

Figure 5:
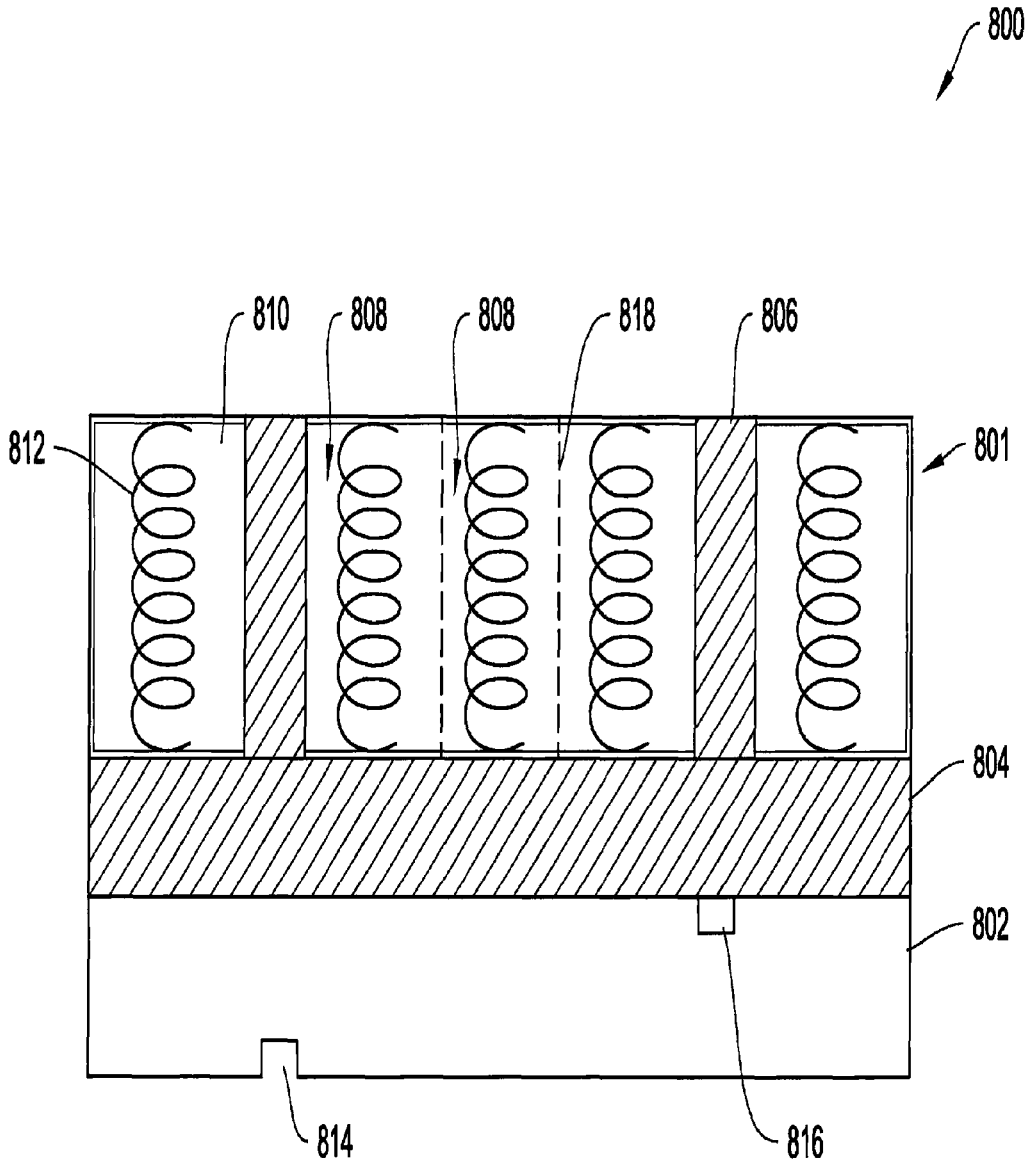
FIG. 5 depicts a cross-section view of mattresses, according to an illustrative embodiment of the invention.

In certain embodiments, the one or more top layers disposed on the support foam layer may include features to ease articulation of the mattress along the hinge channels. In one example, the top layer may include reinforcing support structures disposed near the region of the channels. FIG. 5 illustrates a cross section view of a mattress 800 having a top layer 801 that includes an innerspring construction combined with one or more layers of foam 806. In one example, the top layer 801 is disposed on a middle foam layer 804. Alternatively, the top layer 801 and the middle foam layer 804 may be unitarily formed as a composite layer, disposed on top of the support foam layer 802. The support foam layer 802 includes channels 814 and 816 to allow articulation of the mattress 800. The support foam layer 802 may be similar to support foam layer 102 of FIG. 1.

The top layer 801 may include an innerspring encased coil construction having a plurality of coils 812 that are disposed in pockets 808 and 810. In certain embodiments, the coils 812 may be arranged in rows along a sheet of pocket material (e.g., upholstery or fabric). The pocket material may then be wrapped around the coils 812 and sealed (e.g., by heat-sealing techniques) along lines 818 to seal the coils 812 in the pockets. The encased coils may be arranged on a foam block 804, which in turn may be disposed on the support foam layer 802.

In certain embodiments, foam blocks 806 may be disposed in between a plurality of coil springs, and may be aligned above one or more channels 814 and 816 on the support foam layer 802. In certain embodiments, the encased coils may be attached to the foam blocks 806 to provide further reinforcement. In other embodiments, foam material is poured into the innerspring coil construction to fill one or more gaps between the coils. In such embodiments, the foam material may be poured in liquid or gel form and may subsequently cure to provide an integrated foam and spring top layer 801.

In certain embodiments, the mattress 800 includes one or more sidewalls disposed or attached to at least one of the top layer 801, middle layer 804 and support layer 802. The sidewalls may include foam. In such embodiments, the sidewalls may include one or more channels formed thereon. The channels may be configured so as to form a contiguous channel(s) with the support foam layer. The sidewalls may be sized, shaped and cut as desired depending on the dimensions of the mattress. The sidewalls may or may not include one or more channels that are aligned with the one or more channels on the support foam 802. The sidewalls may or may not include one or more channels that are not aligned with the one or more channels on the support foam layer 802. The channels on the sidewalls may be sized and shaped similar to the channels on the support foam layer 802.

Variations, modifications, and other implementations of what is described may be employed without departing from the spirit and scope of the invention. More specifically, any of the method, system and device features described above or incorporated by reference may be combined with any other suitable method, system or device features disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

The invention claimed is:

1. A mattress having multiple flexure points for articulating the mattress into different positions, the mattress comprising:

a top layer having a top surface and a bottom surface, wherein the top layer comprises an innerspring, a support foam layer disposed below the bottom surface of the top layer, having a top surface, a bottom surface, a first side wall, a second side wall, and a support layer thickness, wherein the support foam layer includes a first channel extending from the first side wall to the second side wall along the bottom surface of the support foam layer, and a second channel extending from the first side wall to the second side wall along the top surface of the support foam layer, at least one additional layer disposed between the support foam layer and the top layer, wherein said at least one additional layer includes at least one of foam or springs, wherein the first and second channels each comprise a first vertical wall and a second vertical wall, the vertical walls spaced a width apart by a bottom wall, and wherein the first channel has a first depth less than the support layer thickness and the second channel has a second depth less than the support layer thickness, the first and second channels defining the flexure points, and wherein the top layer further comprises foam blocks disposed between a plurality of coil springs in the innerspring, wherein each of the foam blocks is aligned with a selected one of the first and second channels.

2. The mattress of claim 1, wherein the innerspring top layer comprises wrapped coil springs.

3. The mattress of claim 1, wherein at least one of the at least one additional layer and support foam layer includes at least one of polyurethane, latex, and visco foam.

4. The mattress of claim 1, wherein the widths of the first channel and the second channels allow for consistent firmness in the top layer.

5. The mattress of claim 4, wherein at least one of the first channel and the second channel is about ⅓ inch to about ¾ inch wide.

6. The mattress of claim 1, wherein the depth of at least one of the first and the second channels extends about ⅓ to about ½ of the thickness of the support foam layer.

7. The mattress of claim 1, wherein the depth of at least one of the first and second channels extends perpendicular from the bottom and top surface, respectively, of the support foam layer.

8. The mattress in claim 1, wherein at least one of the first channel and the second channel is sufficiently deep to allow flexing and reduce mechanical stress on the point of articulation of the mattress.

9. The mattress in claim 1, wherein the support foam layer is sufficiently rigid/firm to accommodate the load of the top layer.

10. A mattress having multiple flexure points for articulating the mattress into different positions, the mattress comprising:

a top layer having a top surface and a bottom surface, wherein the top layer comprises an innerspring, and a support foam layer disposed below the bottom surface of the top layer, having a top surface, a bottom surface, a first side wall, a second side wall, and a support layer thickness, wherein the support foam layer includes a first channel extending from the first side wall to the second side wall along the bottom surface of the support foam layer, and a second channel extending from the first side wall to the second side wall along the top surface of the support foam layer, and wherein the first channel has a first depth less than the support layer thickness and the second channel has a second depth less than the support layer thickness, wherein the first and second channels each comprise a first vertical wall and a second vertical wall, the vertical walls spaced a width apart by a bottom wall, wherein the width is constant across the support foam layer and is within a range of about ⅛ inch to 1.5 inches, and wherein the first and second channels define the flexure points, and at least one additional layer disposed between the support foam layer and the top layer, wherein said at least one additional layer includes at least one of foam or springs, wherein the top layer further comprises foam blocks disposed between a plurality of coil springs in the innerspring, wherein each of the foam blocks is aligned with a selected one of the first and second channels.

* * * * *